US010881196B1

(12) United States Patent
Tyson

(10) Patent No.: US 10,881,196 B1
(45) Date of Patent: Jan. 5, 2021

(54) PERFECT BRUSH

(71) Applicant: Joshua Tyson, New York, NY (US)

(72) Inventor: Joshua Tyson, New York, NY (US)

(73) Assignee: Joshua Tyson, New York, NY (US)

( * ) Notice: Subject to any disclaimer, the term of this patent is extended or adjusted under 35 U.S.C. 154(b) by 0 days.

(21) Appl. No.: 16/873,609

(22) Filed: May 22, 2020

(51) Int. Cl.

| | |
|---|---|
| ***A46B 15/00*** | (2006.01) |
| ***A45D 40/26*** | (2006.01) |
| ***A45D 33/00*** | (2006.01) |
| ***A45D 42/00*** | (2006.01) |
| ***A46B 9/02*** | (2006.01) |

(52) U.S. Cl.
CPC ..... *A46B 15/0077* (2013.01); *A45D 33/00* (2013.01); *A45D 40/262* (2013.01); *A45D 42/00* (2013.01); *A46B 9/021* (2013.01); *A46B 15/0036* (2013.01); *A46B 2200/1046* (2013.01)

(58) Field of Classification Search
CPC ..... A46B 15/0036; A46B 15/0077; A45D 34/04; A45D 34/041; A45D 34/042; A45D 34/043; A45D 34/045; A45D 34/046; A45D 34/047; A45D 34/048; A45D 40/26; A45D 40/261; A45D 40/262; A45D 40/264; A45D 40/265; A45D 40/267; A45D 40/268; A45D 40/28; A45D 27/18; A45D 42/02
USPC ..... 132/320, 288, 313, 316; 362/136, 137
See application file for complete search history.

(56) References Cited

U.S. PATENT DOCUMENTS

| | | | | | |
|---|---|---|---|---|---|
| 1,021,639 | A * | 3/1912 | Smith | G02B 7/182 | 359/875 |
| 1,616,104 | A * | 2/1927 | Bardera | A46B 15/0055 | 132/309 |
| 4,716,915 | A * | 1/1988 | Burns | A45D 34/02 | 132/148 |
| 4,768,531 | A * | 9/1988 | Broussard | B26B 21/40 | 132/313 |
| 4,917,132 | A * | 4/1990 | Tuchman | A45D 33/26 | 132/316 |
| 5,178,478 | A * | 1/1993 | Ryder | A45D 40/18 | 132/315 |
| 5,709,232 | A * | 1/1998 | Sheffler | A45D 33/006 | 132/295 |

(Continued)

FOREIGN PATENT DOCUMENTS

| | | | | |
|---|---|---|---|---|
| WO | WO-9417691 A2 * | 8/1994 | A46B 15/0077 |
| WO | WO-9912448 A1 * | 3/1999 | A46B 15/0077 |

*Primary Examiner* — Tatiana L Nobrega
*Assistant Examiner* — Sarah Woodhouse

(57) ABSTRACT

The makeup application brush with detachable illuminated mirror is comprised of a cosmetic brush and a lighted mirror integrated into one device. The lighted mirror is attached to a proximal end of the makeup application brush handle with the makeup brush head at a distal end of the makeup application brush handle. The makeup application brush is separated by screwing apart the handle for independent use of the lighted mirror or cosmetic brush. The lighted mirror segment is powered by USB charging. With the provision of visibility and lighting from the lighted mirror, the makeup application brush can be used for makeup application or makeup removal. The makeup application brush is innovative in the beauty industry field by combining two beauty accessories: a lighted mirror and a makeup application brush into one device.

3 Claims, 10 Drawing Sheets

(56) References Cited

U.S. PATENT DOCUMENTS

| | | | | |
|---|---|---|---|---|
| 5,913,317 | A * | 6/1999 | Tiram | A45D 42/08 132/289 |
| 6,138,688 | A * | 10/2000 | Lombardi, Jr. | A45D 40/18 132/297 |
| 7,044,142 | B2 * | 5/2006 | Gueret | A45D 40/267 132/216 |
| 7,127,770 | B2 * | 10/2006 | Clegg | A46B 15/0002 15/105 |
| 8,726,916 | B2 * | 5/2014 | Park | A46B 5/0095 132/313 |
| 9,101,193 | B1 * | 8/2015 | Liu | A45D 33/32 |
| 10,582,763 | B1 * | 3/2020 | Villarreal | A46B 15/0036 |
| 2005/0135088 | A1 * | 6/2005 | Helenowski | A45D 40/18 362/136 |
| 2012/0279516 | A1 * | 11/2012 | Bouix | A45D 33/26 132/301 |
| 2014/0174464 | A1 * | 6/2014 | Drugeon | A45D 40/18 132/200 |
| 2015/0094123 | A1 * | 4/2015 | Yeiser, IV | H02J 7/00 455/573 |
| 2016/0113374 | A1 * | 4/2016 | Lim | A45D 33/32 132/288 |
| 2017/0019700 | A1 * | 1/2017 | Tseng | H04N 7/186 |

* cited by examiner

PERFECT BRUSH

BACKGROUND

The makeup application brush with illuminated mirror is a makeup brush with a lighted mirror attached to a proximal end of a handle of the makeup brush. It can be utilized as a single device with a makeup brush and lighted mirror attached together or separated and used independently. The makeup brush has a first handle section and the lighted mirror has a second handle section, the first and second handle sections can be separated by screwing the first and second handle sections apart. Both components of the makeup application brush with illuminated mirror are products of the beauty industry. In modern art, cosmetic brushes and lighted mirrors exist independently. The makeup application brush with illuminated mirror advances from previous art by fusing and integrating a makeup brush with a lighted mirror. The makeup application brush can be utilized using its lighted mirror for lighting and visibility while simultaneously using makeup brushes for makeup application or removal. The makeup application brush with illuminated mirror has a USB port on its handle for charging. The makeup application brush with illuminated mirror can alleviate the necessity of carrying a lighted mirror and a separate makeup brush in a purse or handbag.

SUMMARY

In brief summary the perfect brush is a cosmetic brush that has a lighted mirror attached to the posterior end of handle. The perfect brush advances in art by combining two beauty accessories into one. By screwing the brush handle apart the handle separates into an independent makeup brush and a lighted mirror. Both, the cosmetic brush and the lighted mirror can be utilized simultaneously or independently for makeup application or removal. The lighted mirror highlights the facial area for makeup application or removal. In current art cosmetic brushes and lighted mirrors exist independently. By combining both beauty accessories the perfect brush becomes compact, accommodating and an efficient beauty accessory. The lighted mirror has usb port for charging.

DETAILED DESCRIPTION OF THE INVENTION

Figure 1:
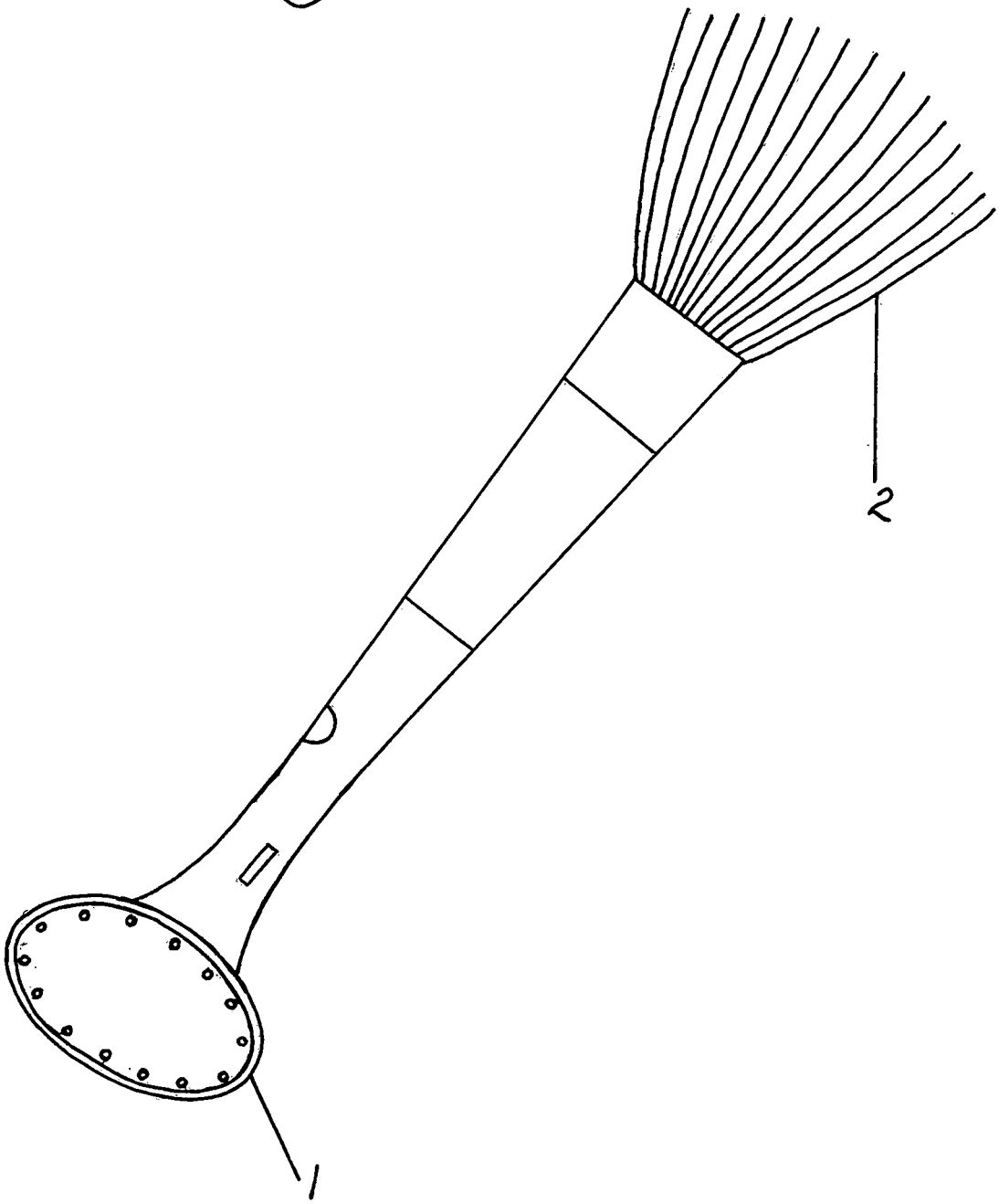
FIG. 1 is a three dimensional view of a first embodiment of the makeup application brush assembled as a single device with a lighted mirror 1, and cosmetic brush 2, attached together.
Figure 2:
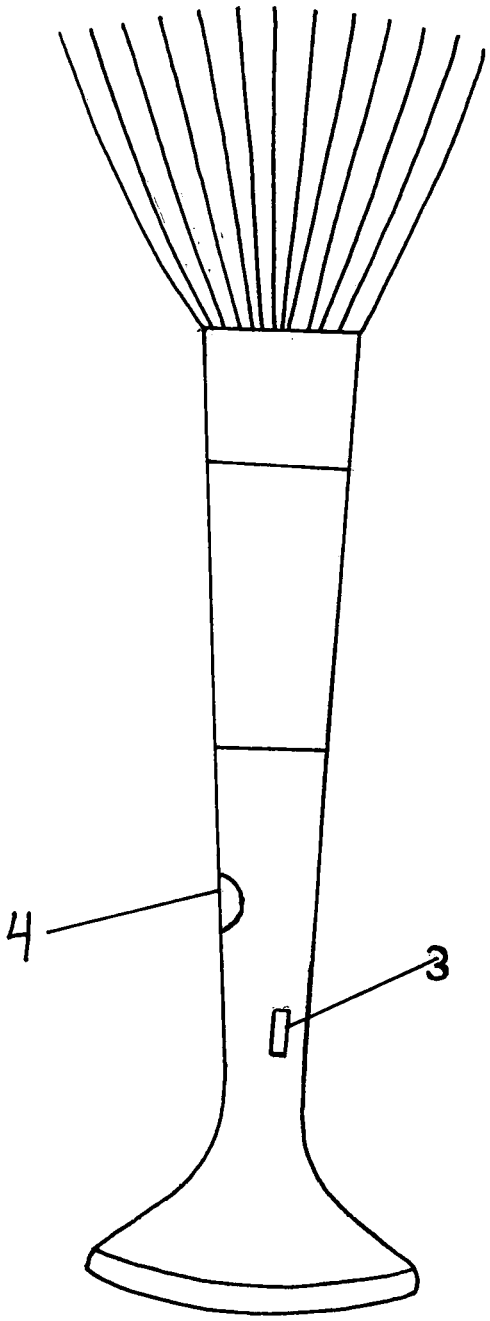
FIG. 2 shows a vertical front view of the perfect brush of FIG. 1 with a USB port 3, and a partial view of an activation button 4.
Figure 3:
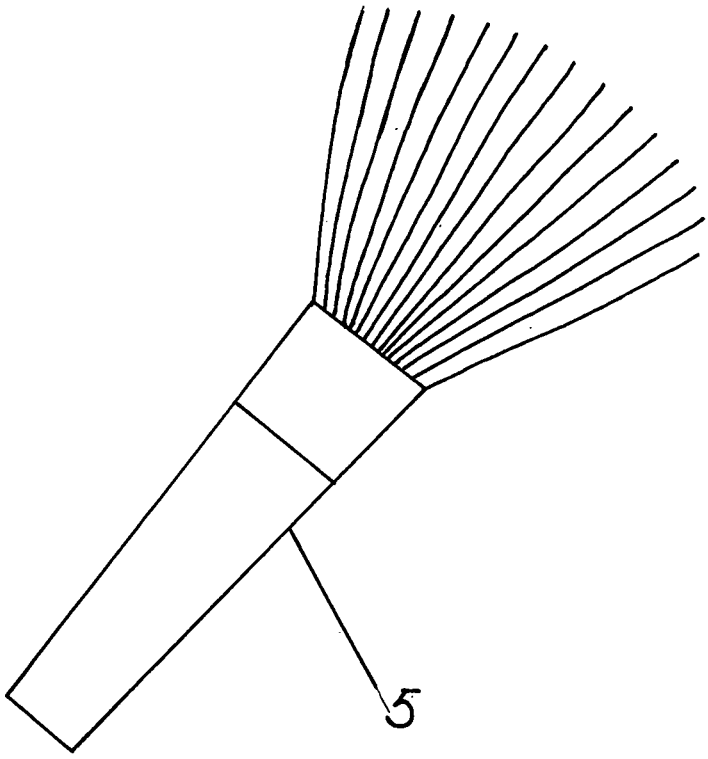
FIG. 3 shows a side view of a brush head segment 5, separated from the makeup brush assembly.
Figure 4:
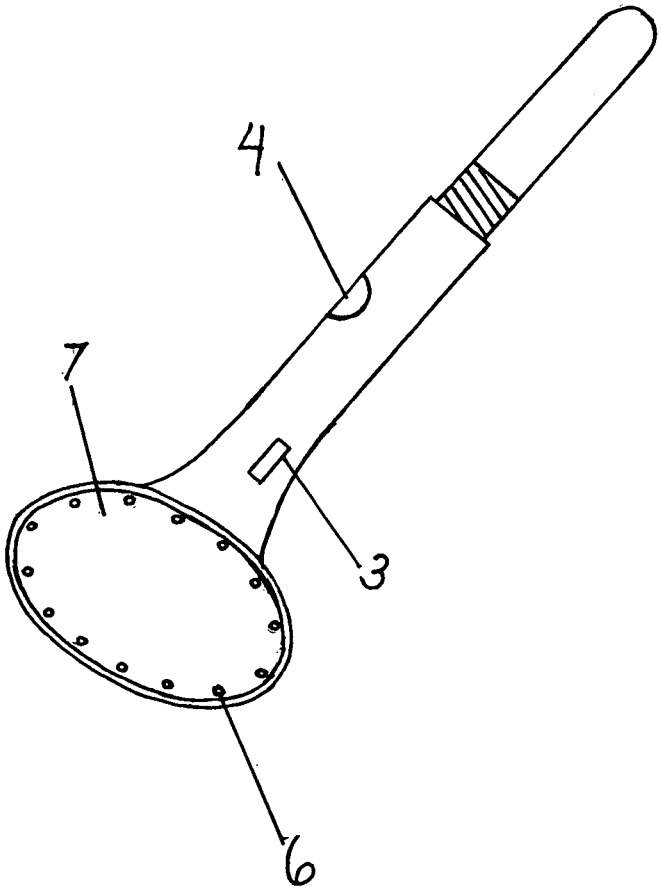
FIG. 4 shows a three dimensional view of a separated lighted mirror segment from brush head segment of the makeup application brush. This drawing also shows a round lighted mirror face 7, at handles bottom with circular led lights 6, and a partial view of activation button 4, on handle.
Figure 5:
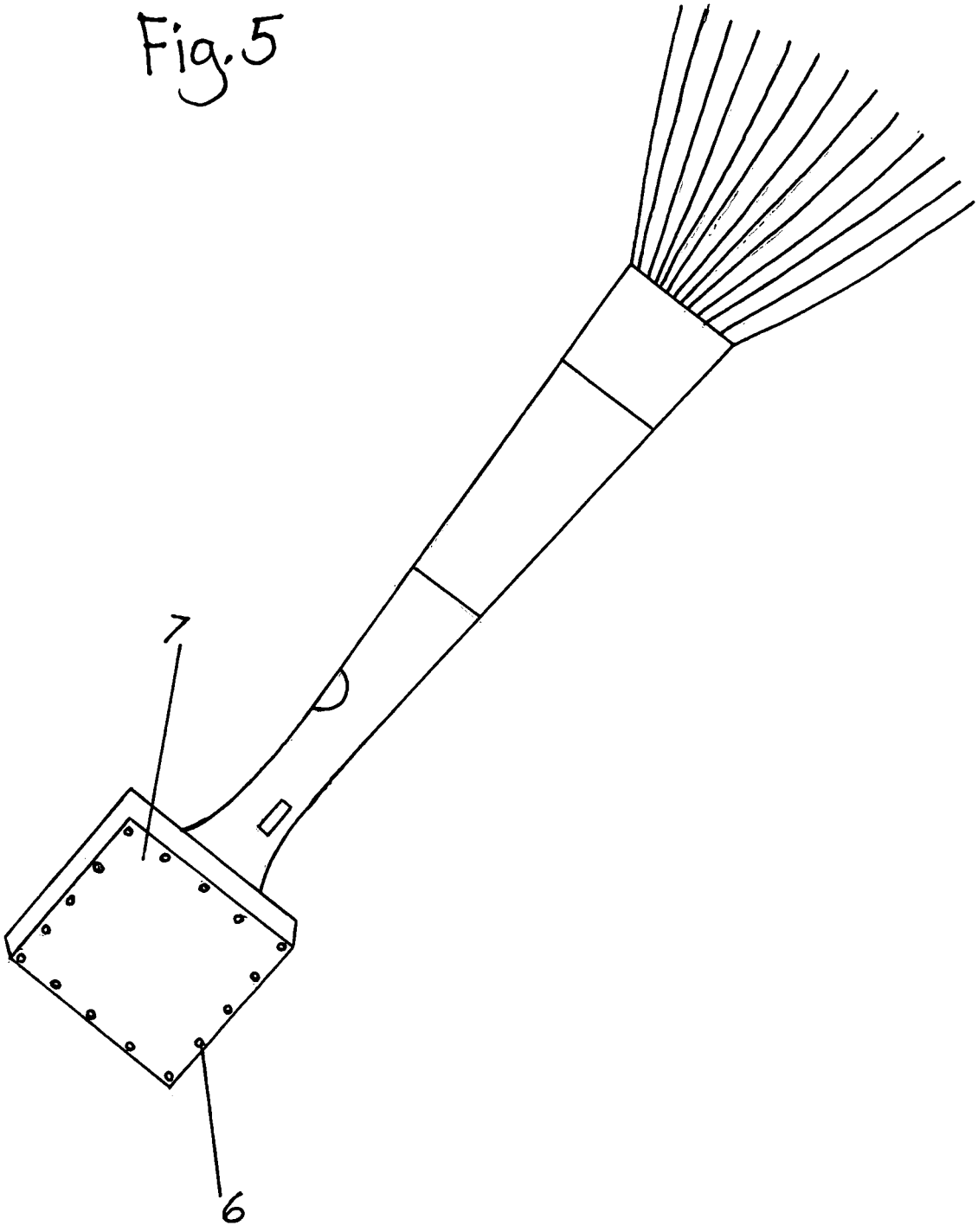
FIG. 5 shows a three dimensional view of the makeup application brush with a square lighted mirror face 7, on the bottom framed with circular led lights 6.
Figure 6:
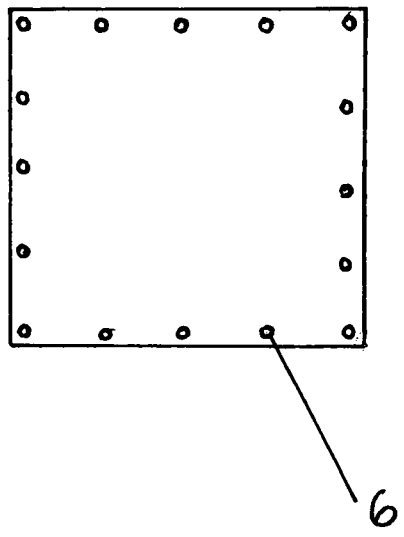
FIG. 6 shows a top view of FIG. 5 having a square lighted mirror face 7, framed with circular led lights 6.
Figure 7:
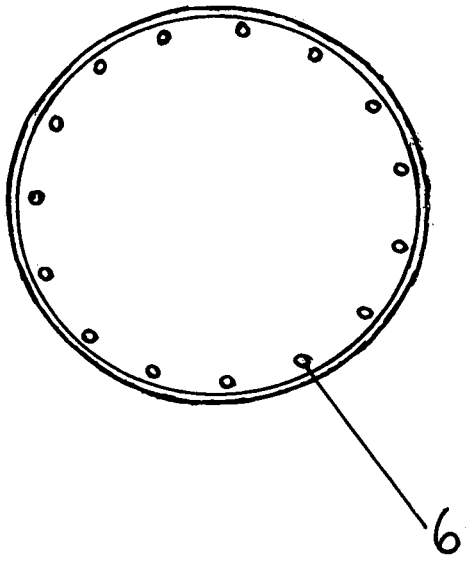
FIG. 7 shows top view of FIG. 1, having a round lighted mirror face 7, encircled with led lights 6
Figure 8:
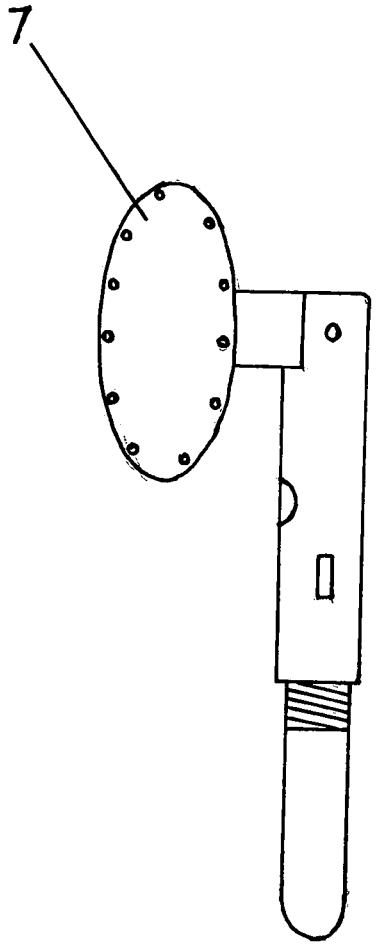
FIG. 8 shows a three dimensional view of a second embodiment of the makeup application brush comprising a pivotably connected lighted mirror segment 7 turned to a 90-degree angle.
Figure 9:
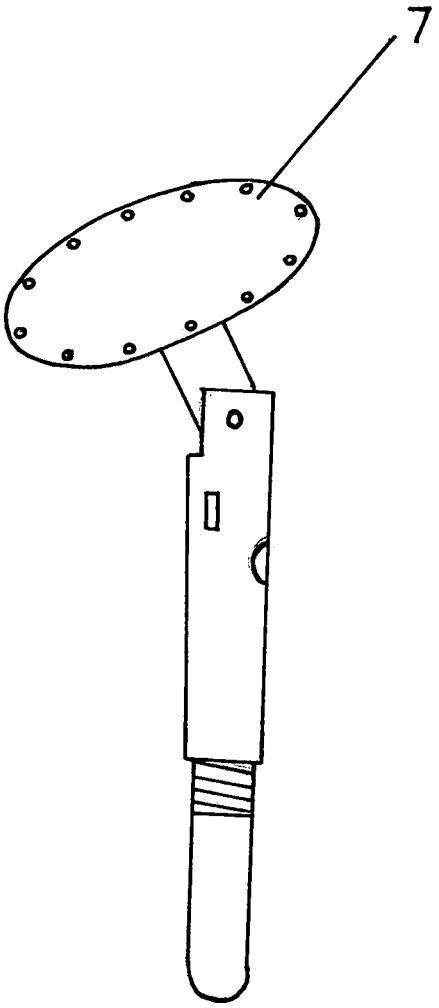
FIG. 9 shows a three dimensional vertical view of the second embodiment of the makeup application brush with the pivotably connected mirror of FIG. 8, pivoted to a 60-degree angle.
Figure 10:
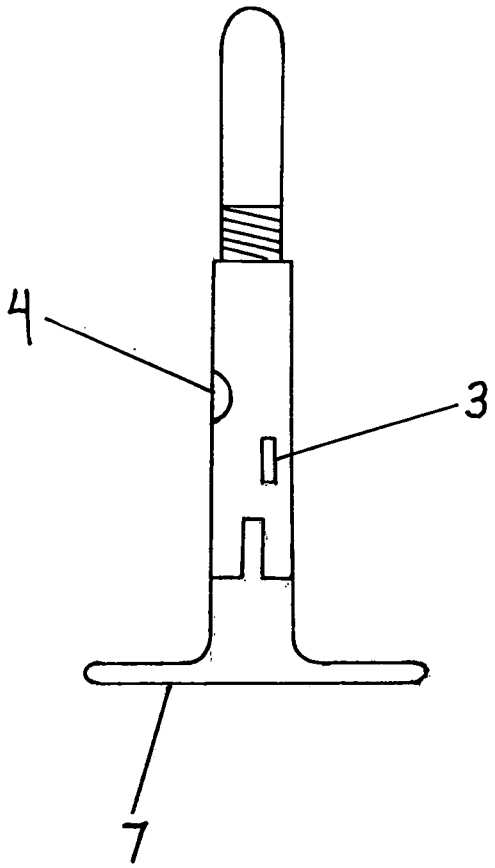
FIG. 10 shows a front view of a vertical standing lighted mirror segment with lighted mirror face 7, down. This drawing also shows USB port 3, and activation button 4.

FIGS. 1-10 illustrate two embodiments of a makeup application brush. The makeup application brush is a cosmetic brush comprising a first handle section threadingly engaged to a second handle section. The first handle section comprises a brush head 2, the second handle section comprises a lighted mirror. The threaded engagement thereby allows the makeup application brush to separate into two segments by screwing apart. The second handle section has a lighted mirror 1 comprising a mirror face 7, attached at a proximal end thereof. When separated, the first handle section with brush head 2, functions as a conventional cosmetic brush that is used for touch ups and makeup application. The lighted mirror is attached to a proximal end of the second handle section. The second handle section is made in two embodiments. The first embodiment of the second handle section, as illustrated in FIGS. 1-7, provides the lighted mirror attached stationary to the proximal end of the second handle section. The second embodiment of the second handle section provides the lighted mirror pivotably connected to the proximal end of the second handle section such that the lighted mirror that can swivel to different angles. The makeup application brush, when separated can be utilized as a miniature vanity when applying or removing makeup. The makeup application brush further comprises a USB port 3 for charging the lighted mirror and an activation button 4 on handle. When separated, the second handle section of the makeup application brush has an extended handle that inserts into the cavity of the first handle section for re-assembly. The makeup assembly brush serves as a two in one brush by having a cosmetic brush integrated with a lighted mirror.

The invention claimed is:

1. A makeup application brush consisting of:

an elongated handle having a first handle section and a second handle section, the first and second handle sections each having opposing proximal and distal ends, wherein a longitudinal axis extends between the proximal end of the second handle section and the distal end of the first handle section;

the first handle section has a threaded cavity proximal end and the second handle section has a threaded extention portion proximate its distal end and a central portion disposed between the threaded extention portion and a distal portion, the threaded extention portion of the second handle section is threadingly engaged within an interior of the cavity of the first handle section to provide a generally smooth exterior surface of the elongated handle;

the first handle section tapers such that the cross-section thereof decreases along the longitudinal axis from the distal end to the proximal end;

a brush head disposed at the distal end of the first handle section, the brush head being formed by a single bundle of elongated bristles, wherein the bristles protrude outwardly and extend generally longitudinally from the distal end of the first handle section;

the second handle section has a similar cross-sectional area at the threaded extention, and flares outwardly from a proximal end of the central portion toward the proximal end to define a maximum cross-sectional area at the proximal end of the second handle section;

a mirror coupled to the proximal end of the second handle section, wherein a reflective surface of the mirror is oriented substantially perpendicularly to the longitudinal axis;

a plurality of LEDs positioned about a perimeter of the mirror for illumination;

a USB port provided on the second handle section for charging the plurality of LEDs;

an activation on the second handle section for activating the plurality of LEDs;

wherein during use, the second handle section is unthreaded from the first handle section thereby allowing a user to apply or remove makeup with the cosmetic application brush while viewing an area of makeup application with the mirror, the mirror being illuminated by the LEDs.

2. The makeup application brush of claim 1, wherein the perimeter of the mirror is square or round.

3. A makeup application brush consisting of:

an elongated handle having a first handle section and a second handle section, the first and second handle sections each having opposing proximal and distal ends, wherein a longitudinal axis extends between the proximal end of the second handle section and the distal end of the first handle section;

the first handle section has a threaded cavity proximate its proximal end and the second handle section has a threaded extension portion proximate its distal end, the threaded extension portion of the second handle section is threadingly engaged within an interior of the cavity of the first handle section to provide a generally smooth exterior surface of the elongated handle;

the first handle section tapers such that the cross-section thereof decreases along the longitudinal axis from the distal end to the proximal end;

a brush head disposed at the distal end of the first handle section, the brush head being formed by a single bundle of elongated bristles, wherein the bristles protrude outwardly and extend generally longitudinally from the distal end of the first handle section;

a mirror mounted on a mirror support the mirror support comprising a proximal end and a distal end, a reflective surface of the mirror is positioned at the proximal end of the mirror support and is substantially perpendicular to an axis extending between the proximal and distal ends of the mirror support, where the distal end of the mirror support is pivotably connected to the proximal end of the second handle section such that the mirror support is configured to pivot with respect to the second handle section to form an angle between 0 and 90 degrees with respect to the longitudinal axis;

a plurality of LEDs positioned about a perimeter of the mirror for illumination;

a USB port provided on the second handle section for charging the plurality of LEDs;

an activation button on the second handle section for activating the plurality of LEDs;

wherein during use, the second handle section is unthreaded from the first handle section thereby allowing a user to apply or remove makeup with the cosmetic application brush while viewing an area of makeup application with the mirror, the mirror being illuminated by the LEDs.

* * * * *